United States Patent [19]

Solomon et al.

[11] 4,185,142

[45] Jan. 22, 1980

[54] OXYGEN ELECTRODE REJUVENATION METHODS

[75] Inventors: Frank Solomon, Great Neck, N.Y.; Donald F. Lieb, Mentor; Ronald L. LaBarre, Euclid, both of Ohio

[73] Assignee: Diamond Shamrock Corporation, Cleveland, Ohio

[21] Appl. No.: 932,229

[22] Filed: Aug. 9, 1978

[51] Int. Cl.[2] ..... H01M 6/50

[52] U.S. Cl. ..... 429/49; 29/623.1

[58] Field of Search ..... 429/49; 29/623.1; 204/98, 290 R

[56] References Cited

U.S. PATENT DOCUMENTS

| | | | |
|---|---|---|---|
| 1,561,775 | 11/1925 | Carpenter | 29/623.1 |
| 2,731,408 | 1/1956 | Clarke | 204/180 |
| 2,731,411 | 1/1956 | Clarke | 204/180 |
| 3,041,317 | 6/1962 | Gibbs | 260/79.3 |
| 3,067,276 | 12/1962 | Gruneberg et al. | 429/49 |
| 3,236,756 | 2/1966 | Beer | 204/98 |
| 3,242,010 | 3/1966 | Bodine | 136/86 |
| 3,282,875 | 1/1966 | Connelly et al. | 260/29.6 |
| 3,423,245 | 1/1969 | Dorland, Jr. et al. | 136/120 |
| 3,467,586 | 10/1969 | Grotheer et al. | 204/298 |
| 3,624,053 | 11/1971 | Gibbs et al. | 260/79.3 R |
| 3,632,498 | 1/1972 | Beer | 204/290 F |
| 3,711,385 | 1/1973 | Beer | 204/59 |
| 3,751,296 | 8/1973 | Beer | 117/230 |
| 3,776,834 | 12/1973 | O'Leary | 204/290 F |
| 3,784,399 | 1/1974 | Grot | 117/62.1 |
| 3,855,092 | 12/1974 | O'Leary | 204/128 |
| 3,875,043 | 4/1975 | Franks et al. | 204/290 F |
| 3,878,083 | 4/1975 | De Nora et al. | 204/290 F |
| 3,887,499 | 6/1975 | Hodgdon | 260/2.2 R |
| 3,926,671 | 12/1975 | Gutjahr | 29/623.1 |
| 3,933,616 | 1/1976 | Beer | 204/290 F |
| 4,055,709 | 10/1977 | Medford | 429/49 |

FOREIGN PATENT DOCUMENTS

| | | | |
|---|---|---|---|
| 1184321 | 5/1968 | United Kingdom | 323/47 |

*Primary Examiner*—Charles F. LeFevour

*Attorney, Agent, or Firm*—Bruce M. Winchell

[57] ABSTRACT

Disclosed are methods for rejuvenation of oxygen electrodes which maximize the power efficiency available from such oxygen electrodes while minimizing the voltage necessary to operate such oxygen electrodes over extended periods of time. These methods include in situ and out of cell techniques using hot water washing followed by air drying and dilute acid washing followed by air drying.

9 Claims, 2 Drawing Figures

OXYGEN ELECTRODE REJUVENATION METHODS

BACKGROUND OF THE INVENTION

The present invention relates generally to the rejuvenation of an oxygen electrode for use in an electrolytic cell and particularly for the production of chlorine and caustic (sodium hydroxide) in such a manner as to significantly reduce the voltages necessary for the operation of such electrolytic cells and to increase substantially the power efficiencies available from such electrolytic cells utilizing oxygen electrodes over extended periods of time. More particularly, the present disclosure relates to improved methods of rejuventation of oxygen electrodes which include utilizing in situ or out of cell techniques after substantial potential decay. The techniques include hot water or dilute acid washing followed by air drying at elevated gauge pressures and elevated temperatures. These techniques substantially lower the potentials for renewed periods of time. These techniques can be used several times on the same oxygen electrode to provide greatly extended lifetimes within commercially acceptable potentials. These methods may be utilized singularly or preferably in combination to produce higher power efficiencies at lower voltages so as to produce a more energy-efficient oxygen electrode in an electrolytic cell especially suitable for the production of chlorine and caustic.

Chlorine and caustic are essential large volume commodities which are basic chemicals required by all industrial societies. They are produced almost entirely electrolytically from aqueous solutions of alkaline metal halides or more particularly sodium chloride with a major portion of such production coming from diaphragm type electrolytic cells. In the diaphragm electrolytic cell process, brine (sodium chloride solution) is fed continuously to the anode compartment to flow through a diaphragm usually made of asbestos particles formed over a cathode structure of a foraminous nature. To minimize back migration of the hydroxide ions, the flow rate is always maintained in excess of the conversion rate so that the resulting catholyte solution has unused or unreacted sodium chloride present. The hydrogen ions are discharged from the solution at the cathode in the form of hydrogen gas. The catholyte solution containing caustic soda (sodium hydroxide), unreacted sodium chloride and other impurities, must then be concentrated and purified to obtain a marketable sodium hydroxide commodity and sodium chloride which is to be reused in electrolytic cells for further production of sodium hydroxide and chlorine. The evolution of the hydrogen gas utilizes a higher voltage so as to reduce the power efficiency possible from such an electrolytic cell thus creating an energy inefficient means of producing sodium hydroxide and chlorine gas.

With the advent of technological advances such as dimensionally stable anodes and various coating compositions therefore which permit ever narrowing gaps between the electrodes, the electrolytic cell has become more efficient in that the power efficiency is greatly enhanced by the use of these dimensionally stable anodes. Also, the hydraulically impermeable membrane has added a great deal to the use of the electrolytic cells in terms of selective migration of various ions across the membrane so as to exclude contaminates from the resultant product thereby eliminating some of the costly purification and concentration steps of processing.

Thus, with the great advancements that have tended in the past to improve the efficiency of the anodic side and the membrane or separator portion of the electrolytic cells, more attention is now being directed to the cathodic side of the electrolytic cell in an effort to improve the power efficiency of the cathodes to be utilized in the electrolytic cells to achieve significant energy savings in the resultant production of chlorine and caustic. Looking more specifically at the problem of the cathodic side of a conventional chloride and caustic cell, it may be seen that in a cell employing a conventional anode and a cathode and a diaphragm therebetween, the electrolytic reaction at the cathode may be represented as $$2H_2O+2e^- \text{ yields } H_2+2OH^-$$

The potential of this reaction versus a standard $H_2$ electrode is $-0.83$ volts.

The electrical energy necessarily consumed to produce the hydrogen gas, an undesirable reaction of the conventional cathode, has not been counter balanced efficiently in the industry by the utilization of the resultant hydrogen since it is basically an undesired product of the reaction. While some uses have been made of the excess hydrogen gas, those uses have not made up the difference in the expenditure of electrical energy necessary to evolve the hydrogen. Thus, if the evolution of a hydrogen could be eliminated, it would save electrical energy and thus make production of chlorine and caustic a more energy efficient reaction.

The oxygen electrode presents one possibility of elimination of this reaction since it consumes oxygen to combine with water and the electrons available at the cathode in accordance with the following equation $$2H_2O+O_2+4e^- \text{ yields } 4OH^-$$

The potential for this reaction is $+0.40$ volts which would result in a theoretical voltage savings of 1.23 volts over the conventinal cathode. It is readily apparent that this reaction is more energy efficient by the very absence of the production of any hydrogen at the cathode, and the reduction in potential as shown above. This is accomplished by feeding an oxygen rich fluid such as air or oxygen to an oxygen side of an oxygen electrode where the oxygen has ready access to the electrolytic surface so as to be consumed in the fashion according to the equation above. This does, however, require a slightly different structure for the electrolytic cell itself so as to provide for an oxygen compartment on one side of the cathode so that the oxygen rich substance may be fed thereto.

The oxygen electrode itself is well known in the art since the many NASA projects utilized to promote space travel during the 1960s also provided funds for the development of a fuel cell utilizing an oxygen electrode and a hydrogen anode such that the gas feeding of hydrogen and oxygen would produce an electrical current for utilization in a space craft. While this major government-financed research effort produced many fuel cell components including an oxygen electrode the circumstances and the environment in which the oxygen electrode was to function was quite different from that which would be experienced in a chlor-alkali cell. Thus while much of the technology gained during the NASA projects is of value in the chlor-alkali industry with regard to development of an oxygen electrode, much further development is necessary to adapt the oxygen electrode to the chlor-alkali cell environment.

Some attention has been given to the use of an oxygen electrode in a chlor-alkali cell so as to increase the efficiency in the manner described to be theoretically feasible, but thus far the oxygen electrode has failed to receive significant interest so as to produce a commercially effective or economically viable electrode for use in an electrolytic cell to produce chlorine and caustic. While it is recognized that a proper oxygen electrode will be necessary to realize the theoretical efficiencies to be derived therefrom, the chlor-alkali cell will require operational methodology significantly different from that of a fuel cell since an electric potential having a higher current density will be applied to the chlor-alkali cell for the production of chlorine and caustic in addition to the supply of an oxygen-rich fluid to enhance the electrochemical reaction to be promoted. Also, presently the potential of the cell rises after a period of time due to deterioration of the cathode which wipes out the energy savings initially achieved. Therefore, it would be advantageous to develop the methodology for the rejuvenation of an oxygen electrode directed specifically toward the maximization of the theoretical electrical efficiencies possible with such an oxygen electrode in a chlor-alkali electrolytic cell for the production of chlorine and caustic for extended periods of time.

SUMMARY OF THE INVENTION

It is, therefore, an object of the present invention to provide a methodology of rejuvenation of an oxygen electrode which will enhance and maximize the energy efficiencies to be derived from an oxygen electrode within the environment of a chlor-alkali electrolytic cell for extended periods of time.

These and other objects that present invention, together with the advantages thereof over existing and prior art forms which will become apparent to those skilled in the art from the detailed disclosure of the present invention as set forth herein and below, are accomplished by the improvements herein shown, described and claimed.

It has been found that a failed oxygen electrode which has been in use in a chlor-alkali electrolytic cell may be rejuvenated by a method comprising the steps of: washing the oxygen electrode with a solution selected from the group of water or a dilute acid solution; and drying the oxygen electrode with a gaseous substance at elevated temperature.

The preferred embodiments of the subject invention are shown and described by way of example in this disclosure without attempting to show all of the various forms and modifications in which the subject invention might be embodied; the invention being measured by the appended claims and not by the details of this disclosure.

DESCRIPTION OF THE PREFERRED EMBODIMENTS

Figure 1:
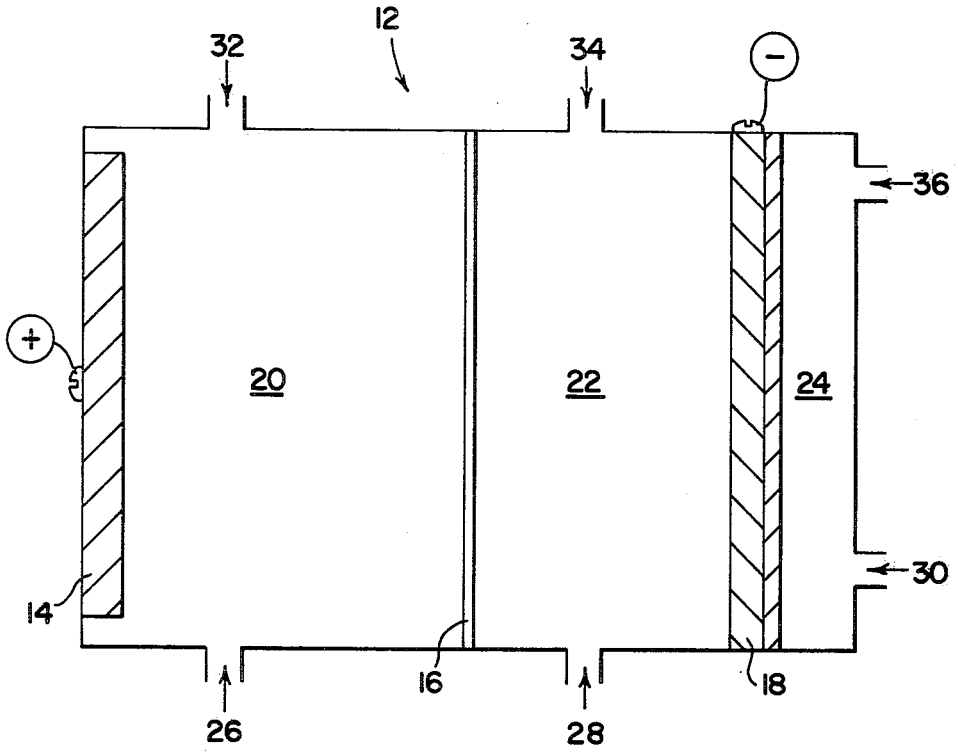
FIG. 1 is a schematic view of an electrolytic cell for the production of halogen gas and alkali metal hydroxides according to the concepts of the present invention.

Referring to FIG. 1, numeral 12 refers to a monopolar divided electrolytic cell which is suitable for use according to the concepts of the present invention. It is recognized that various other designs for electrolytic cells could incorporate the methods according to the concepts of the present invention, but that for illustration purposes the present schematic more amply describes the details of the present invention. Electrolytic cell 12, as shown in FIG. 1, would generally have some environmental supporting structure or foundation to maintain each electrolytic cell 12 in correct alignment so as to build a bank of electrolytic cells for production purposes. The details of this environmental structure have not been shown for ease of illustrating the concepts of the present invention. The cell itself could be manufactured from various materials either metallic or plastic in nature as long as these materials resist the severe surroundings of the chlorine environment, and temperature characteristics during the operation of the basic chlor-alkali cell which are well known in the art. Such materials generally include but are not limited to metallic materials such as steel, nickel, titanium and other valve metals in addition to plastics such as polyvinylchloride, polyethylene, polypropylene, fiberglass and others too numerous to mention. The valve metals include aluminum, molybdenum, niobium, titanium, tungsten, zirconium and alloys thereof.

It can be observed from the drawing that the electrolytic cell 12 shown has an anode 14, a separator 16, and a cathode 18 such that three individual compartments are formed within the electrolytic cell being mainly the anode compartment 20, the cathode compartment 22, and the oxygen compartment 24.

The anode 14 will generally be constructed of a metallic substance, although graphitic carbon could be used as in the old elecrodes which have largely been discarded by the industry presently. These anodes, particularly if they are to be used in a chlor-alkali cell 12, would generally be active material resistant to the anolyte such as a valve metal. A preferred valve metal based upon cost, availability and electrical chemical properties is titanium. There are a number of forms a titanium substrate may take in the manufacture of an electrode, including for example, solid metal sheet material, expanded metal mesh material with a large percentage open area, and a porous titanium with a density of 30 to 70 percent pure titanium which can be produced by cold compacting titanium powder. If desired, the porous titanium can be reinforced with titanium mesh in the case of large electrodes.

Usually, these substrate materials will have a surface coating to protect the material against passivation such as to make same what is generally known in the art as a dimensionally stable anode. Most of these coatings contain a noble metal, a noble metal oxide either alone or in combination with a valve metal oxide or other electrocatalytically active corrosion-resistant materials. These so-called dimensionally stable anodes are well-known and are widely used in the industry. One type of coating for instance would be a Beer-type coating which can be seen from U.S. Pat. Nos. 3,236,756; 3,632,498; 3,711,385; 3,751,296; and 3,933,616. Another type of coating utilized is one which tin, titanium and ruthenium oxides are used for surface coating as can be seen in U.S. Pat. Nos. 3,776,834 and 3,855,092. Two other examples of surface coatings include a tin, antimony with titanium and ruthenium oxides as found in U.S. Pat. No. 3,875,043 and a tantalium iridium oxide coating as found in U.S. Pat. No. 3,878,083. There are, of course, other coatings which are available to those skilled in the art for use in chlor-alkali cells as well as other types of applications in which electrodes would be necessary for electrolytic reactions.

There are a number of materials which may be utilized for the separator 16 as shown in the drawing. One type of material, of course, anticipates the use of a substantially hydraulically impermeable or a cation exchange membrane as it is known in the art. One type of hydraulically impermeable cation exchange membrane, which can be used in the apparatus of the present invention, is a thin film of flourinated copolmer having pendant sulfonic acid groups. The fluorinated copolymer is derived from monomers of the formulas:

$$CF_2{=}CF{+}R{+}_nSO_2F \quad (1)$$

in which the pendant $-SO_2F$ groups are converted to $-SO_3H$ groups, and monomers of the formula $$CF_2{=}CXX^1 \quad (2)$$

wherein R represents the group $$-\underset{}{\overset{R^1}{\overset{|}{C}}}F-CF_2-O{+}CFY-CF_2-O-)_m$$

in which the $R^1$ is fluorine or fluoroalkyl of 1 thru 10 carbon atoms; Y is fluorine or trifluoromethyl; m is 1, 2 or 3; n is 0 or 1; X is fluorine, chlorine or trifluoromethyl; and $X^1$ is X or $CF_3{+}CF_2{+}_aO-$, wherein a is 0 or an integer from 1 to 5.

This results in copolymers having the repeating structural units $$-CF_2-\underset{\underset{SO_3H}{|}}{\underset{(R)_n}{\underset{|}{CF}}}- \quad (3)$$

and $$-CF_2-CXX^1- \quad (4)$$

In the copolymer there should be sufficient repeating units, according to formula (3) above, to provide an $-SO_3H$ equivalent weight of about 800 to 1600. Materials having a water absorption of about 25 percent or greater are preferred since higher cell voltages at any given current density are required for materials having less water absorption. Similarly, materials having a film thickness (unlaminated) of about 8 mils or more, require higher cell voltages resulting in a lower power efficiency.

Typically, because of large surface areas of the membrane in commercial cells, the substrate film material will be laminated to and impregnated onto a hydraulically permeable, electrically non-conductive, inert, reinforcing member such as a woven or non-woven fabric made of fibers of asbestos, glass, TEFLON, or the like. In film/fabric composite materials, it is preferred that the laminating produce an unbroken surface of the film resin on at least one side of the fabric to prevent leakage through the substrate film material.

The materials of this type are further described in the following patents which are hereby incorporated by reference: U.S. Pat. Nos. 3,041,317; 3,282,875; 3,624,053; 3,784,399 and British Pat. No. 1,184,321. Substrate materials as aforedescribed are available from E. I. duPont deNemours and Co. under the trademark MAFION.

Polymeric materials, according to formulas 3 and 4, can also be made wherein the ion exchange group instead of being a sulfonic acid exchange group could be many other types of structures. One particular type of structure is a carboxyl group ending in either an acid, and ester or a salt to form an ion exchange group similar to that of the sulfonic acid. In such a group instead of having $SO_2F$ one would find $COOR^2$ in its place wherein $R^2$ may be selected from the group of hydrogen, an alkali metal ion or an organic radical. Furthermore, it has been found that a substrate material such as NAFION having any ion exchange group or function group capable of being converted into an ion exchange group or a function group in which an ion exchange group can easily be introduced would include such groups as oxy acids, salts, or esters of carbon, nitrogen, silicon, phosphorous, sulfur, chlorine, arsenic, selenium, or tellurium.

A second type of substrate material has a backbone chain of copolymers of tetrafluoroethylene and hexafluoropropylene and, grafted onto this backbone, a fifty-fifty mixture by weight of styrene and alpha-methyl styrene. Subsequently, these grafts may be sulfonated or carbonated to achieve the ion exchange characteristic. This type of substrate while having different pendant groups has a fluorinated backbone chain so that the chemical resistivities are reasonably high.

Another type of substrate film material would be polymeric substances having pendant carboxylic or sulfonic acid groups wherein the polymeric backbone is derived from the polymerization of a polyvinyl aromatic component with a monovinyl aromatic component in an inorganic solvent under conditions which prevent solvent evaporation and result in a generally copolymeric substance although a 100 percent polyvinyl aromatic compound may be prepared which is satisfactory.

The polyvinyl aromatic component may be chosen from the group including: divinyl benzenes, divinyl toluenes, divinyl naphthalenes, divinyl diphenyls, divinyl-phenyl vinyl ethers, the substituted alkyl derivatives thereof such as dimethyl divinyl benzenes and similar polymerizable aromatic compounds which are polyfunctional with respect to vinyl groups.

The monovinyl aromatic component which will generally be the impurities present in commercial grades of polyvinyl aromatic compounds include: styrene, isomeric vinyl toluenes, vinyl naphthalenes, vinyl ethyl benzenes, vinyl chlorobenzenes, vinyl xylenes, and alpha substituted alkyl derivates thereof, such as alpha methyl vinyl benzene. In cases where high-purity polyvinyl aromatic compounds are used, it may be desirable to add monovinyl aromatic compounds so that the polvinyl aromatic compound will constitute 30 to 80 mole percent of polymerizable material.

Suitable solvents in which the polymerizable material may be dissolved prior to polymerization should be inert to the polymerization (in that they do not react chemically with the monomers or polymer), should also possess a boiling point greater than 60° C., and should be miscible with the sulfonation medium.

Polymerization is effected by any of the well known expedients, for instance, heat, pressure, and catalytic accelerators, and is continued until an insoluble, infusible gel is formed substantially throughout the volume of solution. The resulting gel structures are then sulfonated in a solvated condition and to such an extent that there are not more than four equivalents of sulfonic acid groups formed for each mole of polyvinyl aromatic compound in the polymer and not less than one equivalent of sulfonic acid groups formed for each ten mole of poly and monovinyl aromatic compound in the polymer. As with the NAFION type material these materials may require reinforcing of similar materials.

Substrate film materials of this type are further described in the following patents which are hereby incorporated by reference: U.S. Pat. Nos. 2,731,408; 2,731,411 and 3,887,499. These materials are available from Ionics, Inc., under the trademark IONICS CR6.

Various means of improving these substrate materials have been sought, one of the most effective of which is the surface chemical treatment of the substrate itself. Generally, these treatments consist of reacting the pendant groups with substances which will yield less polar bonding and thereby absorb fewer water molecules by hydrogen bonding. This has a tendency to narrow the pore openings through which the cations travel so that less water of hydration is transmitted with the cations through the membrane. An example of this would be to react the ethylene diamine with the pendant groups to tie two of the pendant groups together by two nitrogen atoms in the ethylene diamine. Generally, in a film thickness of 7 mils, the surface treatment will be done to a depth of approximately 2 mils on one side of the film by controlling the time of reaction. This will result in good electrical conductivity and cation transmission with less hydroxide ion and associated water reverse migration.

The separator 16 could also be a porous diaphragm which may be made of any material compatible with the cell liquor environment, the proper bubble pressure and electrical conductivity characteristics. One example of such a material is asbestos which can be used either in paper sheet form or be vacuum-deposited fibers. A further modification can be effected by adding polymeric substances, generally fluorinated, to the slurry from which the diaphragm is deposited. Also, polymeric materials themselves can be made porous to the extent that they show operational characteristics of a diaphragm. Those skilled in the art will readily recognize the wide variety of materials that are presently available for use as separators in chlor-alkali cells.

The third major component of these subject cells to be utilized according to the methods of the present invention is a cathode 18 as seen in the drawing. The cathode 18, in order to be utilized according to the methods of the present invention, will necessarily be an oxygen electrode. An oxygen electrode or oxygen cathode may be defined as an electrode which is supplied with a molecular oxygen containing fluid to lower the voltage below that necessary for the evolution of hydrogen. The basic support for an oxygen cathode will generally include a current collector which could be constructed of a base metal although carbon black might also be used. The expression base metal is used herein to refer to inexpensive metals which are commercially available for common construction purposes. Base metals are characterized by low cost, ready availability and adequate resistances to chemical corrosion when utilized as a cathode in electrolytic cells. Base metals would include, for instance, iron, nickel, lead and tin. Base metals also include alloys such as mild steels, stainless steel, bronze, monel and cast iron. A preferred base metal is chemically resistant to the catholyte and has a high electrical conductivity. Furthermore, this material will generally be a porous material such as a mesh when used in the construction of an oxygen cathode. A preferred metal, based upon cost, resistance to the catholyte and voltages available, is nickel. Other current collectors would include: tantalum, titanium, silver, silicon, zirconium, niobium, columbium, gold, and plated base metals. Upon one side of this basic support material will be a coating of a porous material either compacted in such a fashion as to adhere to the nickel support or held together with some kind of binding substance so as to produce a porous substrate material. A preferred porous material based upon cost is carbon.

Anchored within the porous portion of the oxygen cathode is a catalyst to catalyze the reaction wherein molecular oxygen combines with water molecules to produce hydroxide groups. These catalysts are generally based upon a silver or a platinum group metal such as palladium, platinum, ruthenium, gold, iridium, rhodium, osmium, or rhenium but also may be based upon semiprecious or nonprecious metal, alloys, metal oxides or organometal complexes. Other such catalysts include silver oxide, nickel, nickel oxide or platinum black. Generally, such electrodes will contain a hydrophobic material to wetproof the electrode structure. These catalyst materials may be deposited upon the surface of the cathode support by electroplating or applying a compound of the catalyst metal such as platinum chloride or a like salt such as $H_3Pt(SO_3)_2OH$ to the support and heating in an oxidizing atmosphere to obtain the catalytic oxide state or just heating to obtain the catalytic metallic state. The catalyst may be deposited on the exterior surface of the support and/or in the pores of the support so long as the oxygen and electrolyte both hve ready access to the coated pores which are catalytic sites. Of course, those skilled in the art will realize that the porosity of the carbon material, the amount and the type of catalytic material used will affect the voltages and current efficiencies of the resultant electrolytic cell as well as their lifetimes. A preferred cathode 18 may be constructed according to U.S. Pat. No. 3,423,247, the disclosure of which is hereby incorporated by reference.

As seen in the drawing, utilizing an anode 14, a separator 16 and oxygen cathode 18 as described above will result in an electrolytic cell 12 having three compartments, basically an anode compartment 20, a cathode compartment 22 and an oxygen compartment 24. In these three compartments, in a chlor-alkali cell, for instance, would be an alkali metal halide solution in the anode compartment 20 as transmitted thereinto through the alkali metal halide solution inlet 26. The alkali metal halide solution preferably would be one which would evolve chlorine gas, such as sodium chloride or potassium chloride. In the cathode compartment 22 would be found an aqueous solution which would be transmitted thereinto through the aqueous solution inlet 28. The aqueous solution must contain sufficient water molecules to be broken down to form the required hydroxide groups necessary for the reaction. In the oxygen compartment 24 through oxygen inlet 30 would be a fluid containing a sufficient amount of molecular oxygen to permit the cell operational characteristics. Such a substance would generally be a gas and most preferably would be air with carbon dioxide removed and humidified or pure molecular oxygen which had been humidified. The reaction products such as chlorine gas would be removed from the anode compartment 20 through the halogen outlet 32 and aqueous NaOH or KOH would be removed from the cathode compartment 22 through the alkali metal hydroxide outlet 34 and an oxygen depleted fluid either in the form of residual pure oxygen or air most preferably would be removed from the depleted fluid outlet 36.

In such a cell 12, the cathode 18 will experience a gradual increase in potential in time which indicates failure of the cathode. This is also manifested in an increase in the overall cell potential. The cathode 18, however, may be rejuvenated to reduce the potential of the cell after substantial decay has occured. Rejuvenation may be defined as a lowering of the potential across the electrodes of a cell 12 in which a cathode 18 is considered to have decayed to the point where it is no longer commercially feasible to continue production of chlorine and caustic therewith. This will generally be a failure potential in the range of −0.700 to −1.15 volts when the voltage is measured against a Hg/HgO reference electrode and a potential rejuvenation or potential lowering in the range of 0.01 to 1.0 volt.

Rejuvenation may be accomplished in situ or out of cell. Both techniques contemplate washing both sides of the cathode 18 with a dilute acid solution or distilled water having a temperature in the range of 40° to 100° C. Examples of acids would include acetic, hydrochloric, sulfuric, carbonic, phosphoric, nitric and boric. The most preferred temperature range seems to be about 50° to 80° C. Furthermore, these wash cycles can be accomplished sequentially as by washing first with an acid solution followed by a water rinsing.

The wash cycle is followed by a drying cycle which in situ would be a flushing with dry air at elevated temperatures and pressures. Generally, elevated pressures are used to avoid delamination of the electrode layers. The temperatures would generally be in the range of 50° to 100° C. and the pressures in the range of 0 to the point of electrode blow through. If the cathode 18 washing is done out of cell, then, following the drying cycle, it is advantageous to use a press to exert 1000 to 3000 pounds per square inch of pressure while maintaining the temperature in the range of 200° to 360° C. At the low end of the pressure and temperature ranges, the time period would be as great as 24 hours while at the high end of the pressure and temperature ranges the time period should be in the range of 30 to 180 seconds.

In order that those skilled in the art may more readily understand the present invention and certain preferred aspects by which it may be carried into effect, the following specific examples are afforded.

EXAMPLE 1

An oxygen electrode according to U.S. Pat. No. 3,423,245, was installed into an electrolytic cell as the cathode and run at 2 amperes per square inch and 60° C. until the voltage reached −0.982 volts as measured against a Hg/HgO reference electrode, when it was considered to have decayed beyond commercial usefulness. The oxygen electrode was then taken out of the cell and was soaked in deionized water for several days. An uncracked partially delaminated section of the oxygen electrode was then washed for 15 minutes in dilute acetic acid at 50° C. It was then rinsed with deionized water, dried and then pressed between two plates for 90 seconds at approximately 2000 pounds per square inch pressure. Upon restart, the following potentials was evident, showing a voltage savings initially of 0.742 volt and, finally, after 60 days, a savings of 0.589 volt over the cathode at the time of initial failure.

| Day | Potential | Day | Potential |
|---|---|---|---|
| 1 | −240 | 23 | −289 |
| 2 | −208 | 24 | −295 |
| 3 | −214 | 25 | −301 |
| 4 | −226 | 26 | −309 |
| 5 | −238 | 27 | −319 |
| 6 | −262 | 28 | −331 |
| 8 | −270 | 29 | −332 |
| 9 | −273 | 30 | −331 |
| 10 | −290 | 31 | −341 |
| 11 | −291 | 34 | −350 |
| 12 | −295 | 35 | −354 |
| 14 | −305 | 36 | −357 |
| 15 | −304 | 37 | −358 |
| 16 | −304 | 38 | −364 |
| 17 | −306 | 41 | −371 |
| 18 | −306 | 42 | −376 |
| 19 | −221 | 43 | −383 |
| 22 | −381 | 44 | −375 |
| | | 45 | −383 |
| | | 49 | −393 |
| | | 60 | failure |

EXAMPLE 2

An oxygen electrode according to U.S. Pat. No. 3,423,245 was run in an electrolytic cell as the cathode at 1 ampere per square inch and 60° C. until the voltage reached −0.577 volts as measured against a Hg/HgO reference electrode. The oxygen electrode was then washed in situ with warm distilled water while the electrolytic cell was shut down. The cell was then slowly started up to attain the same current density and temperature after 24 hours. The potential then was −0.497 for a savings of 0.080 volt.

EXAMPLE 3

An oxygen electrode according to U.S. Pat. No. 3,423,245 was run in an electrolytic cell as the cathode at 1 ampere per square inch and 60° C. until the voltage reached −0.830 volt. The oxygen electrode was removed from the cell and cleaned ultrasonically in 0.1 N HCl solution. Some delamination was apparent so the cathode was then pressed between two nickel plates at about 200 pounds per square inch, heated to 115° C. and left overnight. The oxygen electrode was replaced into the electrolyte cell which was started up slowly. The potential then was −0.760 at 1 asi for a savings of 0.070 volt.

EXAMPLE 4

An oxygen electrode according to U.S. Pat. No. 3,423,245 was run in an electrolytic cell as the cathode at 1 ampere per square inch and 59° C. until the voltage reached −0.577 volt. The oxygen electrode was then washed in situ with 700 ml of 80° C. distilled water, and the air chamber washed with 300 ml. of 80° C. distilled water. Upon start up at 1 asi the potential was −0.497 volt for a savings of 0.080 volt.

EXAMPLE 5

Figure 2:
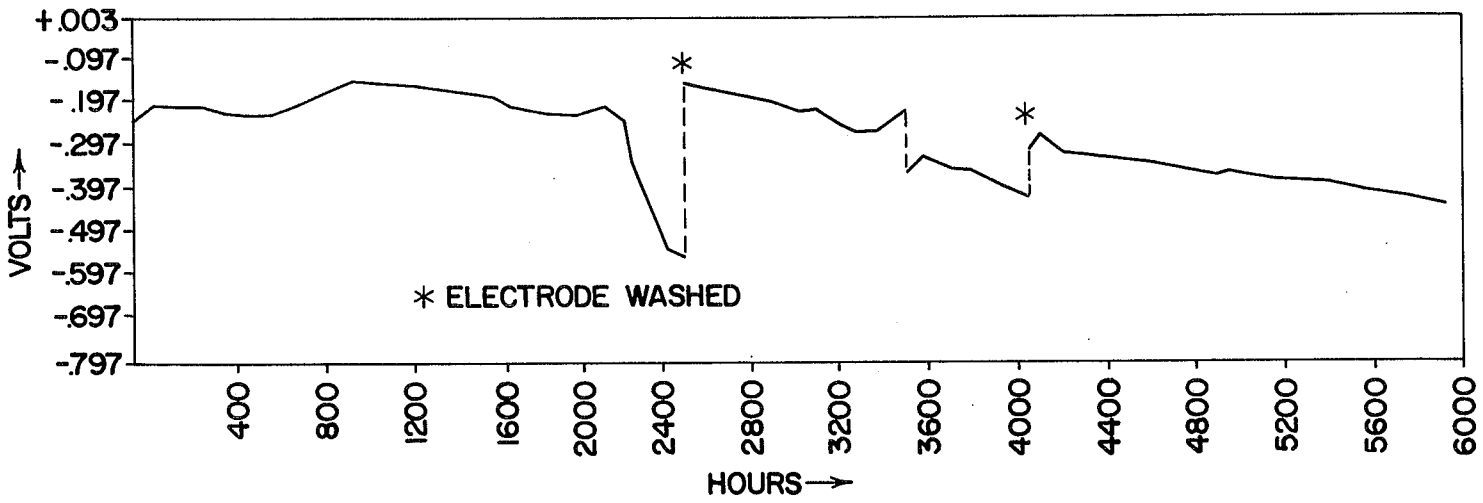
FIG. 2 is a graphical representation of the relationship between elapsed time and measured potential of the cathode according to Example 5.

An oxygen electrode having a substrate made of 30 mesh by 0.009 inch diameter nickel wire, woven cloth with approximately one half mil of silver plating was pressed from 0.018 inch to 0.012 inch thickness before use. The backing was a 65/35 mix of sodium carbonate/TEFLON with the sodium carbonate removed prior to cathode operation. The catalyst was a mix of 82 parts catalyst (30% silver, 70% R B carbon) and 18 parts TEFLON 30. This oxygen electrode was run in an electrolytic cell as the cathode, with 38% KOH at a current density of 0.125 ampere per square centimeter, a temperature of 60°±5° C. and approximately zero Δ pressure, until it was in failure. The oxygen electrode was then rejuvenated by washing in situ with flowing water having a temperature of 60° C. for a time period of 16 hours and subsequently dried with air flow having a temperature of 120° C. for a time period in the range of 1 to 2 hours. This procedure was repeated two times and the results can be seen in the voltage versus time plot on the graphic illustration of FIG. 2 of the drawings. The voltages in FIG. 2 are stated as the cathode against a Hg/HgO reference electrode.

Thus, it should be apparent from the foregoing description of the preferred embodiments that the methods for operation of an oxygen air cathode in an electrolytic cell herein shown and described accomplishes the objects of the invention and solves the problems attendant to such methodology for use in a production chlor-alkali electrolytic cell utilizing an oxygen cathode.

What is claimed is:

1. A method for rejuvenation of a failed oxygen electrode which has been in use in a chlor-alkali electrolytic cell comprising the steps of: washing the oxygen electrode with a solution selected from the group consisting of water or a dilute acid solution; drying the oxygen electrode with a gaseous substance at a temperature in the range of 200° to 360° C.; and subsequent to the drying step, applying a pressure in the range of 1000 to 3000 pounds per square inch for a time period in the range of 30 to 180 seconds.

2. A method according to claim 1 wherein the drying gaseous substance is air.

3. A method according to claim 2 wherein said washing step consists essentially of: a first soaking of the oxygen electrode in deionized water for a period in excess of 24 hours; a second washing of the oxygen electrode in a solution of dilute acetic acid at a temperature in the range of 20° to 80° C. for a time period in the range of 1 to 60 minutes; and a third rinse with deionized water; and wherein subsequent to the drying step, applying pressure of 2000 pounds per square inch at a temperature of 250° C. for a time period of 90 seconds.

4. A method for the in situ rejuvenation of a failed oxygen electrode which has been in use in a chlor-alkali electrolytic cell comprising the steps of: washing the oxygen electrode in situ in the electrolytic cell with a solution selected from the group of water or a dilute acid solution; and drying the oxygen electrode with a gaseous substance at a pressure in the range of 0 to 100 pounds per square inch and a temperature in the range of 40° to 200° C. for a time period in the range of 0.5 to 12 hours.

5. A method according to claim 4 wherein the drying gaseous substance is air.

6. A method according to claim 5 wherein the washing step consists of washing both sides of the oxygen electrode with distilled water having a temperature in the range of 40° to 100° C. for a time period in the range of 1 to 75 hours; and wherein the drying step consists of providing an air flow at the temperature of 120° C. to both sides of the oxygen electrode for a time period in the range of 1 to 2 hours.

7. A method for rejuvenation of a failed oxygen electrode which has been in use in a chlor-alkali electrolytic cell comprising the steps of: washing the oxygen electrode with a solution selected from the group consisting of water or a dilute acid solution; drying the oxygen electrode with a gaseous substance at a temperature in the range of 50° to 200° C. for a time period in the range of 8 to 72 hours; and applying a pressure in the range of 0 to 500 pounds per square inch.

8. A method according to claim 7 wherein the drying gaseous substance is air.

9. A method according to claim 8 wherein the washing step consists of washing in a 0.1 N HCl solution with ultrasonic agitation, and wherein subsequent to the drying step pressing the oxygen electrode between two nickel plates at a pressure of 200 pounds per square inch, a temperature of 115° C. and a time period of 10 hours.

* * * * *